United States Patent [19]

Raymond

[11] Patent Number: 4,559,797

[45] Date of Patent: Dec. 24, 1985

[54] METHOD FOR FORMING STRUCTURAL PARTS

[75] Inventor: Roger S. Raymond, Redondo Beach, Calif.

[73] Assignee: Delaware, El Segundo, Calif.

[21] Appl. No.: 755,867

[22] Filed: Jul. 17, 1985

Related U.S. Application Data

[62] Division of Ser. No. 519,640, Aug. 2, 1983, abandoned.

[51] Int. Cl.[4] ..... B21D 22/12

[52] U.S. Cl. ..... 72/63; 72/342

[58] Field of Search ..... 72/60, 63, 342, 364

[56] References Cited

U.S. PATENT DOCUMENTS

| | | | |
|---|---|---|---|
| 3,934,441 | 1/1976 | Hamilton | 72/342 |
| 4,087,037 | 5/1978 | Schier | 72/63 |
| 4,117,970 | 10/1978 | Hamilton | 72/63 |
| 4,188,811 | 2/1980 | Brimm | 72/63 |
| 4,269,053 | 5/1981 | Agrawol | 72/60 |
| 4,409,809 | 10/1983 | Buchanan | 72/60 |

*Primary Examiner*—Leon Gilden

*Attorney, Agent, or Firm*—Charles T. Silberberg; Max Geldin

[57] ABSTRACT

Method for producing structures from metal workpieces which may or may not be capable of superplastic forming, such as titanium alloy and steel, using a forming die having a predetermined contour or shape and a cooperating pressure diaphragm formed of a metal capable of superplastic forming. Fluid pressure is applied to one side of the pressure diaphragm to cause stretching or expansion thereof by superplastic forming, and forcing the diaphragm against the workpiece, which in turn is caused to move or expand into contact with the forming die, to produce a structural component of predetermined shape. With the proper application of pressure, temperature and time, metal parts, e.g. 8 to 12 inches thick, can be formed in addition to parts formed from comparatively thin sheet metal.

11 Claims, 6 Drawing Figures

METHOD FOR FORMING STRUCTURAL PARTS

This is a division of application Ser. No. 06/519,640, filed Aug. 2, 1983 now abandoned.

BACKGROUND OF THE INVENTION

This invention relates to the production of structural components from metals such as aluminum and titanium, and their alloys, and is particularly concerned with the production of structural parts by forming using a novel means for applying pressure to a workpiece to force same into contact with the forming die.

A number of alloys exhibit superplasticity and are capable of being subjected to superplastic forming to produce parts of predetermined shapes. Superplasticity is the capability of a material to develop unusually high tensile elongation with reduced tendency toward local necking during deformation. Structures have been successfully produced from aluminum, its alloys, and from a number of titanium-based alloys by the superplastic forming (SPF) process, due to the fact that such metals or alloys exhibit superplasticity characteristics.

A requirement has existed for an improved method of forming of heavy plate in many industries. Further, there is a tendency for a conventionally formed part to spring back from the tool or die following the forming operation, resulting in the formation of a distorted part. Furthermore, parts produced by forming often have residual stresses, due to pressure or thermal gradients, and such stresses must be removed by stress relieving operations. Also, when the forming die has complex surface contours, the resulting formed part often does not have the precise matching shape of the contours of the forming die when employing conventional forming apparatus and techniques.

U.S. Pat. No. 4,087,037 to Schier, et al discloses superplastic forming and diffusion bonding apparatus, employing fluid pressure means, including a forming die having a desired contour and a cooperating flexible die matching the contour of the forming die.

U.S. Pat. No. 3,739,617 to Stejskal discloses a forming structure comprising a die with heating electrodes for receiving a metallic blank, and a heat resistant forming diaphragm for pressing the metallic blank over the hot die to form the blank into the desired part. However, such diaphragm is not a high pressure diaphragm, the forming force being created by a vacuum.

It is an object of the present invention to provide a process and apparatus for producing structural members by forming, employing a relatively simple but reliable means for applying pressure to a workpiece to expand same into contact with a forming die having a contoured surface.

Another object of the invention is the provision of a process and apparatus of the type described above, employing a pressure applying means which is operable at high temperatures for superplastic forming of a workpiece while permitting the forming to be utilized in a wide range of shapes of the forming die.

A further object is to provide apparatus and procedure of the type described above which is suitable for forming of heavy plates.

A still further object of the invention is the provision of a procedure and apparatus of the type described above for superplastically forming a metal workpiece and which avoids distortion and residual stresses in the resulting part.

SUMMARY OF THE INVENTION

The above objects and advantages are achieved according to the invention by the provision of forming apparatus comprising a pressure diaphragm of a material capable of superplastic forming, and which at elevated temperature and with the application of suitable applied pressure, expands into contact with a workpiece and forces the workpiece to expand into contact with a forming die, to produce a structural component of predetermined shape.

Thus, the apparatus for producing structural components from a metal workpiece by forming according to the invention, comprises a forming die having a contoured surface of predetermined shape for shaping the workpiece. The forming die is inserted in a die container providing a closed zone around the forming die. As the novel feature of the present invention, a pressure diaphragm of a metal capable of superplastic forming is provided, which cooperates with the forming die. The metal workpiece may also be comprised of a metal capable of superplastic forming, but other metals which do not have this characteristic also can be formed according to the invention, as noted below.

Means, for example, in the form of an upper seal plate is positioned adjacent to the pressure diaphragm and seals the outer periphery of the diaphragm to form a pressure chamber. A fluid supply line is provided for introducing pressure fluid to one side of the pressure diaphragm. Heating platens are provided for heating the pressure diaphragm and workpiece to superplastic forming temperature.

The application of fluid pressure to one side of the pressure diaphragm causes same to expand by superplastic forming against the workpiece positioned in the die container, the workpiece in turn expanding against the forming die to produce a part or structural component of predetermined shape corresponding to the shape of the forming die.

The resultant formed part retains its predetermined shape without distortion. Further, due to the use of a pressure diaphragm which expands by superplastic forming at elevated temperature against both the workpiece and forming die, the diaphragm can conform to almost any complex shape of forming die, to provide a final part precisely matching the contours of the forming die.

In its broad aspects the invention is directed to apparatus for producing formed metal components from a metal workpiece which comprises:

a forming die having a contoured surface for forming a workpiece;

a pressure diaphragm comprised of a metal capable of superplastic forming, cooperating with said forming die;

and means for applying pressure fluid to one side of said pressure diaphragm to expand said pressure diaphragm by superplastic forming against a metal workpiece positioned between said diaphragm and said forming die, and in turn causing said workpiece to expand against said forming die to produce a structural component of predetermined shape corresponding to the contoured surface of said forming die.

BRIEF DESCRIPTION OF THE DRAWING

The invention will be more readily understood by the detailed description below of a preferred embodiment taken in connection with the accompanying drawing wherein.

DETAILED DESCRIPTION OF THE INVENTION AND PREFERRED EMBODIMENTS

Figure 1:
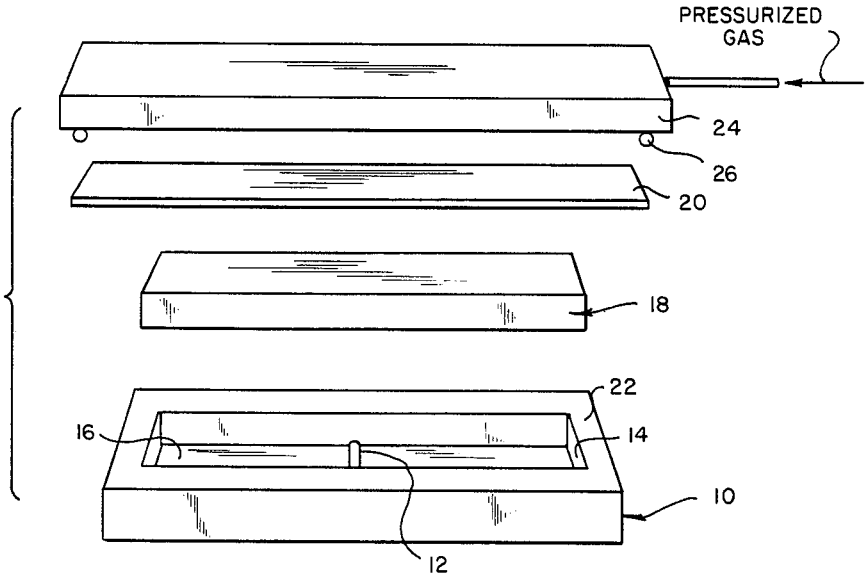
FIG. 1 is an exploded schematic illustration of the basic parts of an apparatus according to the invention for superplastically forming a thick metal plate.
Figure 2:
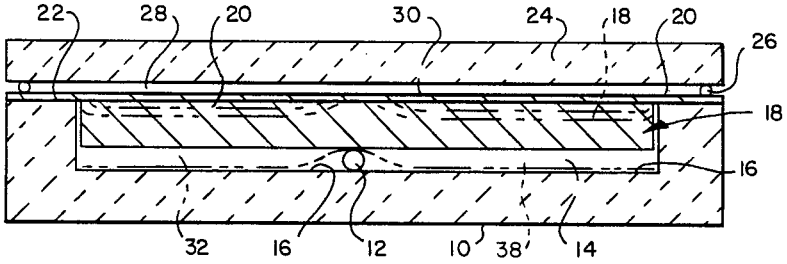
FIG. 2 illustrates the assembled position of the elements of FIG. 1 prior to and following superplastic forming of the plate or workpiece therein.

Referring to FIGS. 1 and 2 of the drawing, numeral 10 represents a lower die forming a container having a drill rod 12 positioned essentially across the enclosed area 14 within the lower die and disposed on the bottom 16 of such die.

A plate 18 is positioned within the interior space 14 of the lower die 10 and resting on the drill rod 12. The plate 18 is relatively thick, for example in one case, 2.25 inch thick, and is formed, e.g. of a metal such as titanium alloy, e.g. 6 Al-4V Ti alloy. Such plate or workpiece can be formed of any metal which is capable of superplastic forming, such as titanium, aluminum, zirconium, and alloys thereof, as well as of other metals which are not known to be superplastically formable but which are capable of forming under suitably elevated temperature and pressure, such as steel. A pressure diaphragm 20 which is relatively thin, e.g. 0.10 inch thick according to one embodiment, is then positioned on the upper outer surface 22 of the lower die 10. The pressure diaphragm 20 is comprised of a metal capable of superplastic forming such as those metals and alloys noted above and of which the workpiece or plate 18 may be comprised, e.g. of 6 Al-4V titanium alloy.

An upper die plate 24 is then positioned over the pressure diaphragm 20. A seal wire or projection 26 is provided around the periphery of the bottom surface of plate 24 for contact with the upper surface of the pressure diaphragm 20. When the upper die is placed on such pressure diaphragm and ram pressure is applied, a sealed upper chamber 28 between the die 24 and diaphragm is obtained.

Referring now to FIG. 2, in carrying out the superplastic forming operation, a conventional stopoff material such as yttria or boron nitride is sprayed on the inner surfaces of the tool or die 10 and on the drill rod 12, and also on the lower surface of the pressure diaphragm 20 to function as a parting agent and lubricant. The titanium plate 18 to be formed is then placed in position within the container 10, and over the drill rod 12, and the pressure diaphragm 20 and upper die 24 are then placed in position as seen in FIG. 2.

The plate 18 and pressure diaphragm 20 are then heated up to the superplastic forming temperature for the titanium alloy utilized in plate 18 and in the pressure diaphragm 20, which is usually about 1600° to about 1700° F., e.g. 1650° F. for 6 Al-4V titanium alloy. For this purpose suitable heating platens (not shown) are employed. During such heating, the interior chamber 14 in the lower die 10 is purged. The upper chamber 28 is then pressurized by flowing pressurized gas, such as argon, air or nitrogen into such chamber to apply a pressure of between about 150 and 600 psi, e.g. about 150 psi, to the upper side 30 of the pressure diaphragm 20. Substantial ram pressure of about 95 tons is applied to the upper die during superplastic forming to counteract the 150 psi internal pressure in chamber 28, and to maintain a seal. On application of the pressure fluid to the upper side of the diaphragm 20 and at the superplastic forming temperature noted above, the diaphragm 20 is forced to expand downwardly against the upper surface of the plate 18 and the force of the diaphragm 20 against the plate 18 causes the plate 18 to expand against the bottom 16 of the lower die 10 and over the drill rod 12, as shown by the dotted line positions of diaphragm 20 and plate 18 in FIG. 2.

Figure 3:
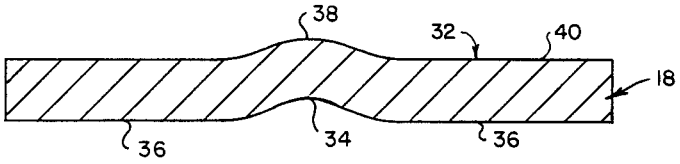
FIG. 3 is a cross-section of a bent plate produced by superplastic forming as illustrated in FIG. 2.

After the superplastic forming operation, the fluid pressure to the upper chamber 28 is released and the apparatus and formed part 32 are allowed to cool in the press. After cooling, the part 32 is removed from the press. It will be noted that hot loading and unloading of plate 18 may also be employed. As seen in FIG. 3, the formed part 32 is in the form of a plate which is bent in the central portion of its lower surface at 34, in conformance with the contour of drill rod 12, and has outwardly extending flat lower surfaces 36 where the plate 18 was forced against the inner flat surface 16 of the lower die 10. The part 32 also has an upper central convex curved portion 38 in the upper surface 40 directly above and in alignment with the lower bend 34.

If desired, a superplastically formable, e.g. titanium alloy plate, such as 18 or a steel plate can be flattened by the apparatus and method described above, by omitting the drill rod 12 at the bottom of the lower die 10.

The same system as illustrated in FIGS. 1 and 2 can be employed to superplastically form aluminum plate at temperature ranging from about 500° to about 960° F. using a superplastically formable aluminum pressure diaphragm.

Figure 4:
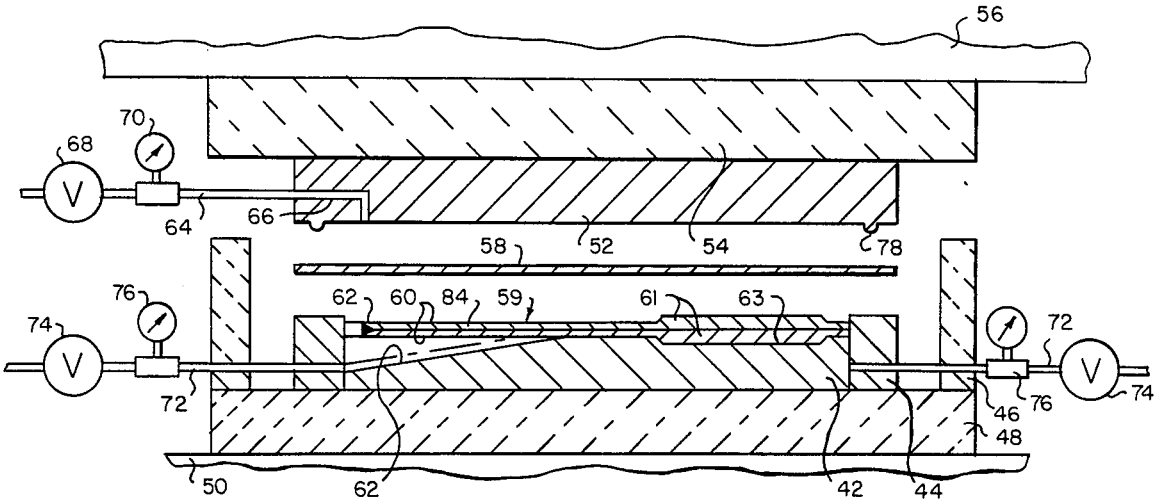
FIG. 4 is an exploded view of another embodiment of apparatus according to the invention for superplastic forming of wing pivot lugs for aircraft.
Figure 5:
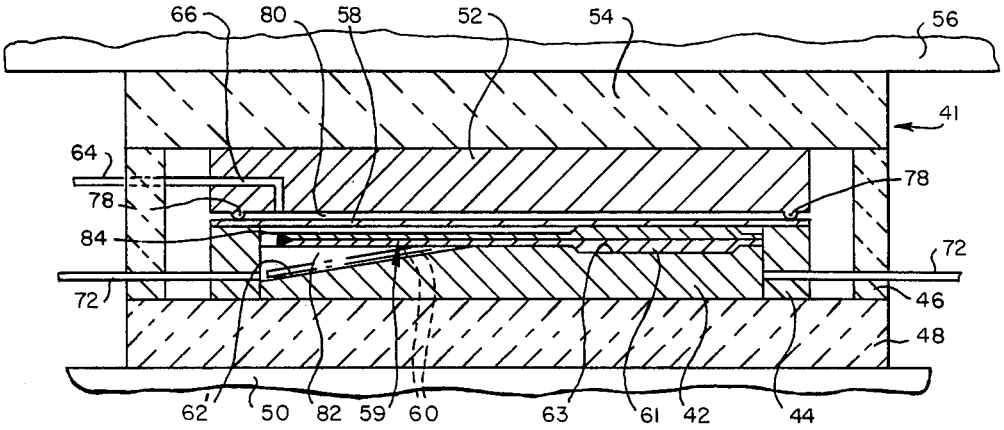
FIG. 5 shows the assembled position of the elements of the apparatus in FIG. 4, prior to and following superplastic forming of the part or workpiece therein.
Figure 6:
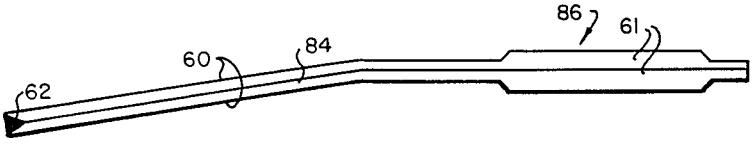
FIG. 6 is a cross-section of the superplastically formed part produced according to FIG. 5.

Now referring to FIGS. 4, 5 and 6, illustrating another embodiment of the present invention, the press 41 is comprised of a form die 42 positioned within a die container 44, the die container 44 being disposed within a ceramic enclosure 46. The form die 42, the die container 44 and the ceramic enclosure 46 rest on an integrally heated ceramic platen 48 which in turn is supported on the press bed 50.

An upper seal plate 5Z is provided which is mounted on an integrally heated upper ceramic platen 54, in turn mounted on a press ram 56. A 6 Al-4V titanium pressure diaphragm 58 is positioned between the upper seal plate 52 and the form die 42.

A machined workpiece 59 comprised of 6 Al-4V titanium alloy, formed of two contacting similar planar sheets or laminates 60 having thicker portions 61 at one end and including a filler 62 of 6Al-4V titanium alloy along one edge thereof between the sheets, is positioned on the form die 42 within the die container 44. It will be noted that the form die 42 has an upper contoured surface 62' on one side thereof for shaping the part 59 by superplastic forming, and has a recess 63 to receive the thick portion 61 of one of the sheets 60.

A pressure fluid line 64 is provided which communicates with a passage 66 in the upper seal plate, the inner lower end of which discharges below the upper seal plate. A valve 68 is provided in the upper pressure fluid line 64, together with a suitable pressure gauge 70. Fluid pressure lines 72 are also provided for communication with the interior of the container 44 containing the form die 42, valves 74 and pressure gauges 76 being provided in lines 72.

It is seen in FIG. 5 that when the components of FIG. 4 are assembled, the pressure diaphragm 58 is positioned on the upper surface of the container 44, and the upper seal plate 52 is positioned on the upper surface of the pressure diaphragm 58. It will be noted that the upper seal plate 52 has a sealing projection 78 around the periphery of the lower surface of plate 52, which contacts the upper surface of the pressure diaphragm 58 to form a sealed upper pressure chamber 80 above the diaphragm 58, and a lower enclosed chamber 82 is formed below the pressure diaphragm 58 within the container 44.

In operation, valves 68 and 74 in lines 64 and 72 are opened during heatup of the press between 800° and 1600 ° F. to purge the upper and lower chambers 80 and 82. At temperature of about 1650° F., argon pressure fluid is introduced via line 64 and passage 66 in the upper seal plate, into the upper chamber 80 against the upper side of the pressure diaphragm 58. The pressure is slowly raised to about 150 psi and maintained at that pressure for a period of time. As the pressure is increased, the pressure diaphragm 58 is expanded downwardly by superplastic forming against the laminates 60 of part 59, and when the diaphragm 58 makes contact with the laminates 60, it forces the outer portion 84 of the laminates 60 downward by expansion and superplastic forming against the contoured surface 62' of the form die 42, thereby forming a contoured shape at the surface of the outer portion 84 of laminates 60, corresponding to the contoured surface 62' of the form die 42, as shown by dotted lines in FIG. 5.

Following superplastic forming, it will be noted that the outer surfaces of both of the laminates 60 have the same contoured shape, as indicated in dotted lines in FIG. 5, and also in FIG. 6. The valve 68 in line 64 is then opened, to reduce the pressure in upper chamber 80. After the superplastically formed part 86 has cooled sufficiently, it is removed from the press. Since as shown particularly in FIG. 5, both of the laminates 60 which are initially machined in flat form, are superplastically formed simultaneously, following superplastic forming, both of the formed laminates of the same shape can be tightly secured together by fasteners (not shown) to provide the final contoured wing pivot lugs 86. The simultaneous superplastic forming of both laminates or sheets 60 provide for precise part-to-part fitup for producing the wing pivot lugs 86.

From the foregoing, it is seen that the invention provides novel apparatus and procedure for superplastic forming of parts, embodying the novel concept of a pressure diaphragm which can be subjected to the high temperature of superplastic forming of the order of 1650° F. or higher, to produce superplastically formed parts in conjunction with a forming die, and which has other advantages including the ability for forming of heavy plates, and production of formed parts free of distortion and residual stresses.

It will be understood that the term "pressure diaphragm" employed herein and in the claims is not intended in any manner to limit the thickness of the superplastically formable member which is used to accomplish forming of a part in conjunction with a forming die, according to the invention.

Since various changes and further modifications of the invention will occur to and can be made readily by those skilled in the art without departing from the invention concept, the invention is not to be taken as limited, except by the scope of the appended claims.

What is claimed is:

1. A method for producing a metallic structure of predetermined shape from a metal workpiece which comprises:

providing an apparatus containing a forming die having a contoured surface of predetermined shape;

positioning a formable metal workpiece adjacent to said forming die;

providing a pressure diaphragm of a metal sheet capable of superplastic forming adjacent to said workpiece;

bringing said diaphragm to within an elevated temperature range suitable for superplastic forming of said diaphragm; and applying pressure to one side of said diaphragm to plastically deform said diaphragm by superplastic forming against said workpiece and in turn deforming said workpiece against said forming die to produce a structural component of predetermined shape.

2. The method of claim 1, wherein said pressure diaphragm is a sealed diaphragm and wherein said applied pressure is fluid pressure.

3. The method of claim 1, wherein said metal workpiece is of a metal capable of superplastic forming.

4. The method of claim 1, wherein said metal workpiece is steel.

5. The method of claim 1, wherein said pressure diaphragm and said workpiece are comprised of a titanium alloy.

6. The method of claim 1, wherein said pressure diaphragm and said workpiece are comprised of aluminum or an aluminum alloy.

7. The method of claim 1 wherein said step of applying pressure is such that said diaphragm conforms to the surface of said workpiece which it contacts.

8. The method of claim 7 wherein during said step of applying pressure, said diaphragm also deforms against a portion of said forming die and said diaphragm conforms to the surface of said forming die where it contacts said forming die.

9. A method for producing a metallic structure of predetermined shape from a workpiece capable of superplastic forming which comprises:

providing an apparatus containing a forming die having a contoured surface of predetermined shape;

positioning a workpiece of a metal capable of superplastic forming adjacent to said forming die;

positioning a pressure diaphragm of a metal sheet capable of superlastic forming adjacent to said workpiece on the opposite side thereof from said forming die;

heating said pressure diaphragm and said workpiece to superplastic forming temperature; and applying pressure to one side of said diaphragm opposite to said workpiece to plastically deform said diaphragm by superplastic forming against said workpiece and in turn deforming said workpiece by superplastic forming against said forming die to produce a structural component of predetermined shape.

10. The method of claim 9, including positioning an upper die adjacent to said pressure diaphragm on the opposite said thereof from said workpiece and providing a seal between said pressure diaphragm and said workpiece to form a pressure chamber therebetween, and applying pressure fluid to said chamber.

11. The method of claim 9, wherein said pressure diaphragm and said workpiece are comprised of a titanium alloy.

* * * * *

UNITED STATES PATENT AND TRADEMARK OFFICE

CERTIFICATE OF CORRECTION

PATENT NO. : 4,559,797

DATED : December 24, 1985

INVENTOR(S) : Roger S. Raymond

It is certified that error appears in the above-identified patent and that said Letters Patent is hereby corrected as shown below:

On the title page assignee should read

-- (73) Assignee: Rockwell International Corporation --.

Signed and Sealed this

*Sixteenth* Day of *September 1986*

[SEAL]

*Attest:*

DONALD J. QUIGG

*Attesting Officer*

*Commissioner of Patents and Trademarks*